US010653285B1

(12) United States Patent
Ruble

(10) Patent No.: US 10,653,285 B1
(45) Date of Patent: May 19, 2020

(54) DETAIL CLEANER

(71) Applicant: Gene David Ruble, The Colony, TX (US)

(72) Inventor: Gene David Ruble, The Colony, TX (US)

( * ) Notice: Subject to any disclaimer, the term of this patent is extended or adjusted under 35 U.S.C. 154(b) by 71 days.

(21) Appl. No.: 15/788,970

(22) Filed: Oct. 20, 2017

Related U.S. Application Data

(63) Continuation of application No. 14/295,255, filed on Jun. 3, 2014, now abandoned.

(60) Provisional application No. 61/830,898, filed on Jun. 12, 2013.

(51) Int. Cl.
*A47L 13/08* (2006.01)
*A47L 13/16* (2006.01)

(52) U.S. Cl.
CPC ..... *A47L 13/08* (2013.01); *A47L 13/16* (2013.01)

(58) Field of Classification Search
CPC ..... A47L 13/08; A47L 13/16; A47L 13/12; A47L 1/06; A47L 13/02; A47L 13/022; A46B 15/0055; A46B 15/0081; B43L 19/00; B43L 19/02; B08B 9/027; B08B 9/04; B08B 9/043; B08B 9/0436; B08B 1/005; A63F 3/068; B23D 79/08; B44D 3/162; B44D 3/164; B60S 3/045
USPC ..... 15/105, 105.51, 105.53, 111, 114, 117, 15/104.16, 236.01, 236.02, 236.03
See application file for complete search history.

(56) References Cited

U.S. PATENT DOCUMENTS 4,059,864 A * 11/1977 Spresny ..... A47L 1/06 15/105
4,742,595 A * 5/1988 Isaacs ..... A47L 1/06 15/105
4,893,370 A * 1/1990 Klotz ..... A47L 1/06 15/121
RE33,860 E * 3/1992 Chen ..... A46B 11/0017 222/391
5,443,533 A * 8/1995 Magnien ..... B05C 17/00 15/105
5,471,700 A * 12/1995 Pereira ..... A47L 13/022 15/143.1
5,920,942 A * 7/1999 Footer ..... A47L 13/14 15/121
6,216,306 B1 * 4/2001 Esterson ..... A46B 5/02 15/111
6,966,094 B1 * 11/2005 Rigakos ..... A47J 37/0786 15/111
2002/0078519 A1 * 6/2002 Boothby ..... A47L 1/06 15/121
2003/0084529 A1 * 5/2003 Rudd ..... A46B 17/08 15/117
2003/0135946 A1 * 7/2003 MacLean ..... A46B 7/04 15/176.4
2005/0011029 A1 * 1/2005 Yu ..... A47L 13/12 15/111

(Continued)

*Primary Examiner* — Justin M Jonaitis
(74) *Attorney, Agent, or Firm* — Jeffrey Roddy

(57) ABSTRACT

An apparatus and system for removing residue from surfaces to be cleaned includes a detail cleaner that can be mounted to a handle or pole. The detail cleaner includes a pole attachment portion with a head portion having a face set substantially 45 degrees relative to the handle. The face includes a recess that tapers inwardly for the insertion and seating of an interchangeable scraper and a coupling for an interchangeable scrubbing pad with plate.

7 Claims, 8 Drawing Sheets

(56) References Cited

U.S. PATENT DOCUMENTS

2008/0060156 A1* 3/2008 Michaels ..... A47L 1/06
15/121
2014/0311524 A1* 10/2014 Call ..... A47L 13/12
134/6

* cited by examiner

DETAIL CLEANER

CROSS REFERENCES TO RELATED APPLICATIONS

This Application is a Continuation in Part of U.S. application Ser. No. 14/295,255 entitled "Detail Cleaner" filed Jun. 3, 2014, which claims benefit to U.S. Provisional Application No. 61/830,898 filed Jun. 12, 2013.

FIELD

The present invention relates generally to an apparatus for detail cleaning of surfaces such as floors and walls.

BACKGROUND

Cleaning devices having both scraping and absorbant components are known in the art. GB 748,246 to Mihailide describes a cleaning device with includes a bent tube that terminates in a sponge and an optional scraper formed in the bent tube. DE 7637585 to Freundenberg describes a cleaning implement with sponge and scraper. U.S. Pat. No. 5,454,659 to Vosbikian et al. describes a cleaning implement with a hollow handle for retaining a liquid medium and a detachable sponge applicator.

While previous devices offer advantages for their intended use, problems remain. Certain surfaces to be cleaned may not require a scraper or may be damaged by its use. Other surfaces may require a more or less aggressive scrubbing pad. Sticky gum-like residues may require more force to remove than is provided by a short handled cleaning implement.

For at least the foregoing reasons it would be desirable to provide a cleaning implement which can be affixed to a longer handle when required, and wherein the implement includes an interchangeable scraper member and an interchangeable pad member, the physical characteristics of which are selected based on the surface to be cleaned and the material to be removed.

It would be desirable to provide interchangeable pad members having varying levels of absorbancy and varying in abrasiveness, from highly absorbent non-abrasive open cell pads to non-absorbent fiber based scrubing pads. In the case of absorbent pads, such pads may be useable to lay down floor sealer as well as lift soil, grease and small debris from a floor surfaces.

It would also be desirable to provide interchangeable scraping members of plastic or metal construction or a combination thereof so that the cleaning task can be tailored to the surface to be cleaned with damaging the surface. Moreover, a sharpenable blade portion may be affixed to a support portion of an interchangeable scraping member.

SUMMARY

The present invention is a cleaning implement that can be either hand held or affixed to a longer handle. The cleaning implement includes a handle attachment portion that is generally tubular sized and shaped to accommodate standard diameter handles. The opening tapers so as to provide a friction fit for the inserted handle end. At the end of the implement opposite the handle is a small cleaning head that includes a platform with a face that is angled substantially 45 degrees relative to the handle portion. A inwardly tapering recess in the face accommodates an interchangeable scraper member that is held in place by friction fit. As scraping action is performed by pushing the cleaning head forward, the seating of the scraping member within the tapered recess is reinforced by the cleaning/scraping motion. While the detail cleaner can be used outfitted only with a scraper, the detail cleaning implement may also be employed with interchangeable pad members that are secured to a platform of the cleaning head via a plate portion for mounting to the face.

In order to use the present invention, cleaning solutions may be applied to either the pad directly or to surface residue to be removed. The scraper is placed on the surface and the cleaning head pushed and pulled over the residue. As the scraper moves forward, it chips away hardened residue and when pulled, the pad wipes away soft and sticky portions of the residue.

The foregoing and other objects, features, and advantages of the invention will become more apparent from the following detailed description, which proceeds with reference to the accompanying figures wherein the scale depicted is approximate.

DETAILED DESCRIPTION OF THE INVENTION

Reference Listing

100 detail cleaning head

110 handle attachment portion

Figure 1:
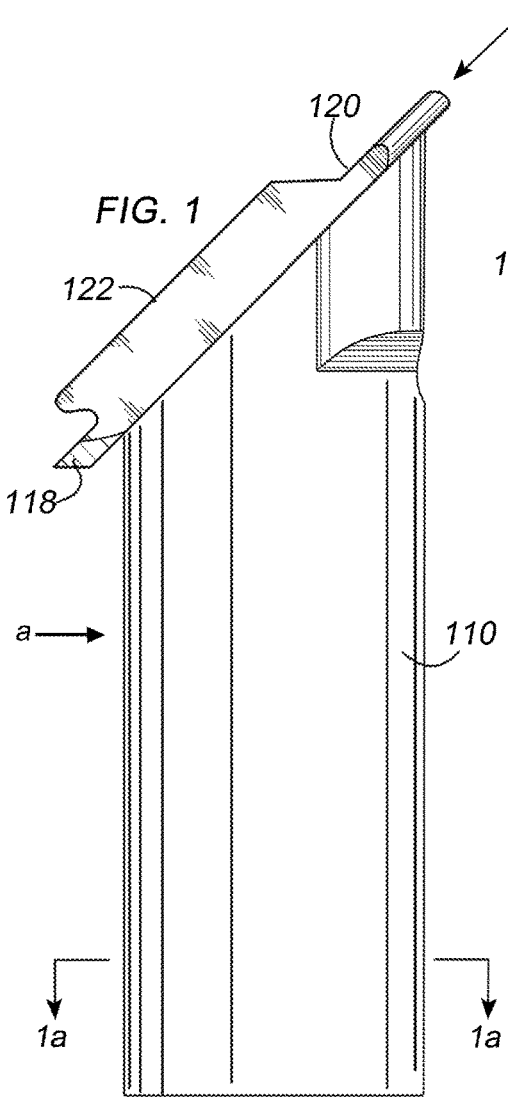
FIG. 1 is a side elevation of an implementation according to the present invention, and, FIG. 1A is a cross-sectional view taken along lines 1*a*-1*a;*
Figure 2:
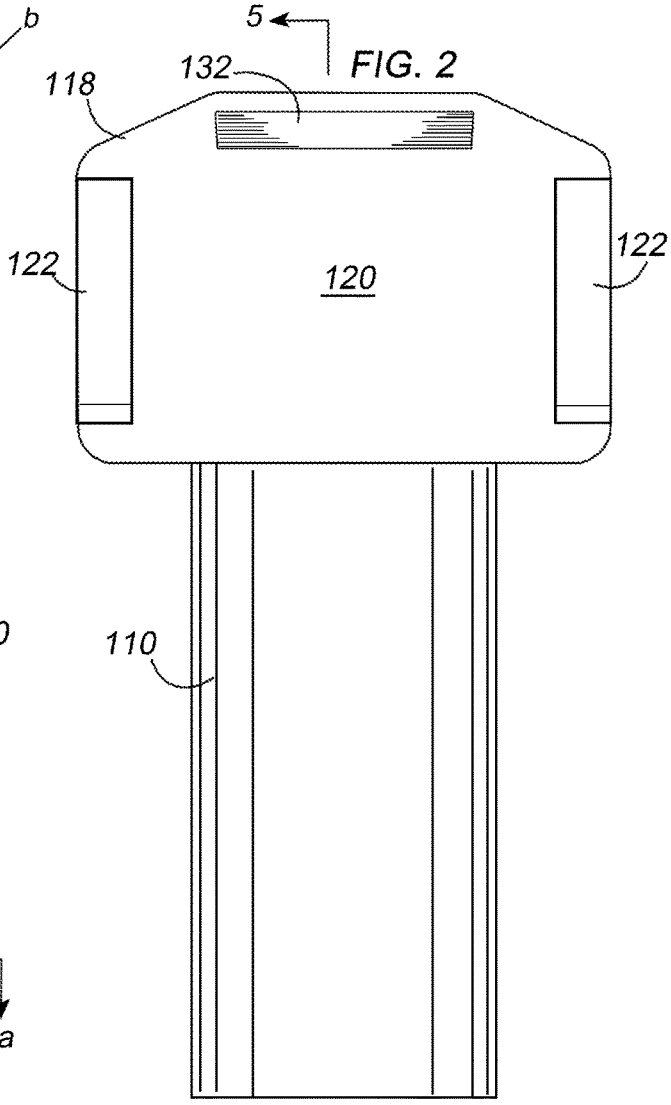
FIG. 2 is another side elevation thereof taken in the direction of arrow (a) of (FIG. 1)
Figure 1A:
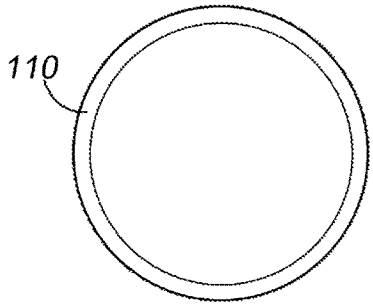
Figure 3:
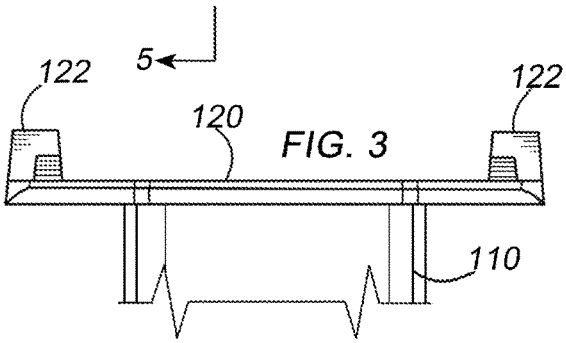
FIG. 3 is view taken in the direction of arrow (b) of (FIG. 1)

112 handle recess
118 platform
120 angled face
122 retention members
123 channel
124 channel stop
125 aperture
130 scraper
131 blade portion
132 scraper recess
133 scraper support
140 pad plate
150 pad
160 plate flanges Definitions In the following description, the term "surfaces" refers to any horizontal or vertical surface, but typically hard surfaces comprising wood, tile or concrete. The term "pad" refers to any absorbent, non-absorbent, abrasive or non-abrasive pad. The term "coupling" means any slidable means for removably coupling the pad to the face of the cleaner head which would be appreciated by those having skill in the art and access to this disclosure. The term "residue" means hard caked or soft material having some adherence to the surface to be cleaned. The term "standard diameter" handle refers to utility handles for push brooms and the like that are anywhere between 1 inch and 1.125 inches in diameter. Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting.

Referring generally to FIGS. 1 through 22, an apparatus for cleaning residue from surfaces includes a handle attachment portion 110 having a tubular recess 112 to accommodate a pole or handle. At one end of the handle attachment portion is a detail head that includes a platform 118 with a face 120 set at substantially 45 degrees relative to the handle attachment portion. The face 120 includes an inwardly tapering recess 132 for the reversible insertion of an interchangeable scraper member 130, and a coupling means that includes a pair of projections, each projection including a channel or groove, and each channel or groove including an open end and a closed end. The channels are configured to receive an absorbent pad or scrubbing pad 150 which when seated, is adjacent to and behind the scraper member. This enables the scraper member to normally contact the floor at the same time as the pad. The detail head can of course be tilted by a user to minimize or maximize the pressure applied to either the scraper or the pad. The opposed and parallel channels 123 are sized and shaped to slidably accept flanged 160 plate adhered to the bottom of an interchangeable pad 150. Other slidable coupling means will suggest themselves to those having skill in the art and access to this disclosure.

Figure 4:
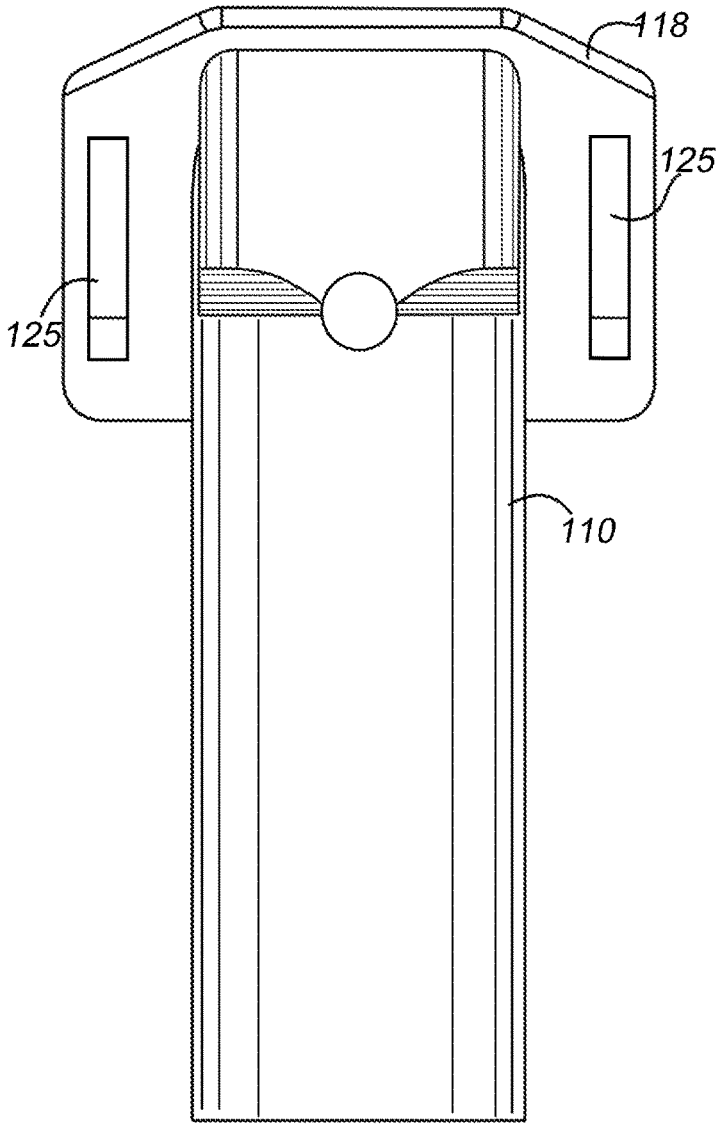
FIG. 4 is a side elevation taken in a direction opposite that of (FIG. 2)
Figure 5:
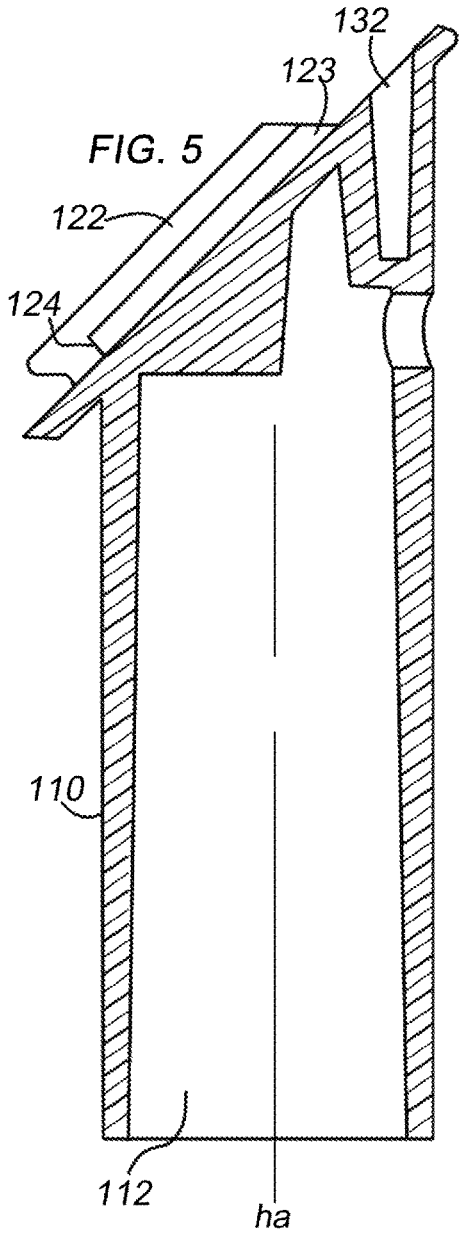
FIG. 5 is a cross-sectional view taken along lines 5-5 of (FIG. 2)
Figure 6:
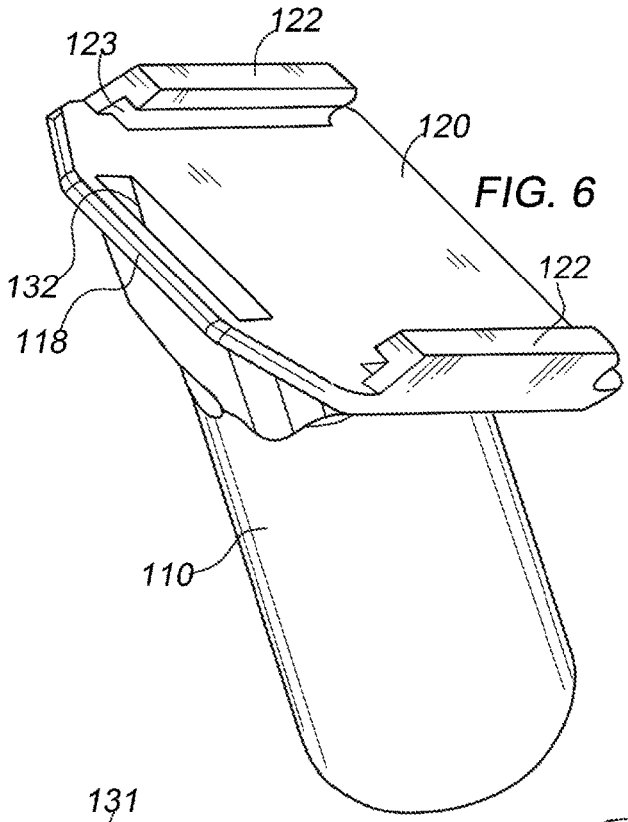
FIG. 6 is a perspective view the implementation shown in (FIGS. 1-5)
Figure 20:
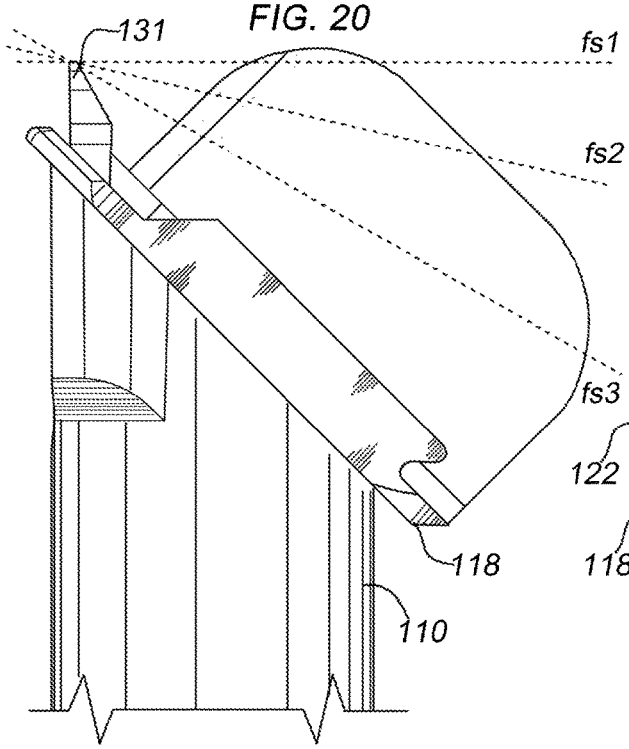
FIG. 20 is a first partial side view thereof.
Figure 21:
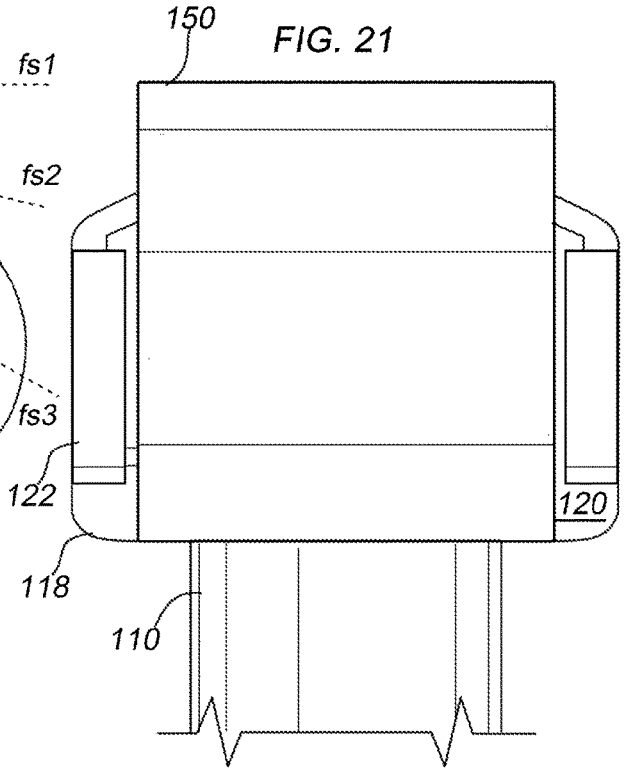
FIG. 21 is a second partial side view thereof.
Figure 22:
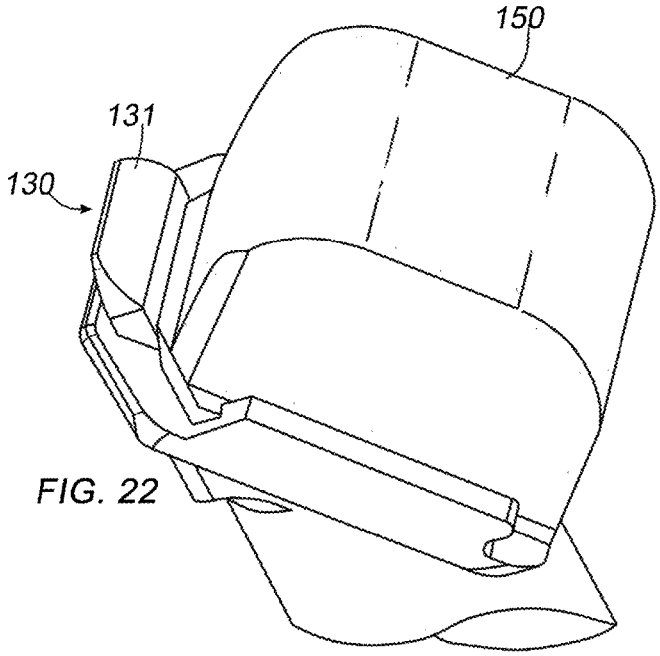
FIG. 22 is a partial perspective view thereof.

As shown best in FIG. 1, face 120 is set at a 45 degree angle relative to the handle so that pad 150 is generally in line with scraper 130 (FIGS. 10-22) when moved over a floor surface (fs) (see also FIG. 20). When the scraper 130 chips away at hardened residue on the forward stroke, loose debris can be moved away by the pad which can be an absorbent pad like a conventional sponge pad, an abrasive pad or a combination in which at least one side of an absorbent pad is laminated to an abrasive cover. As shown in FIG. 4, recess 112 tapers inwardly to provide a friction fit to an inserted handle.

FIGS. 11-18 show an implementation according to the present invention, wherein pad 150 is adhered to plate 140 having flanges 160 that slip into the open ends of channels 170 formed from angled face 120. As shown, the channels have closed ends or stops 124 that secure the plate flanges therein when pushing the implement. Preferably, plate 140 is slightly oversized in thickness so as to sufficiently retain the plate in the channels when pulling the implement across a surface. Scraper 130 is removable and is inserted into an opening 132 in the face 120 that tapers inwardly providing a friction fit.

FIGS. 1-6 shows the structure of an exemplary detail head prior to fitment with the scraper/blade 130 or the pad member 150. While in a preferred implementation, the platform face 120 is substantially at a 45 degree angle relative to the handle axis (FIG. 6, ha), other angles may be contemplated as long as the scraper is disposed to point to the floor along with floor contact by the pad when the handle is held in a conventional manner, typically 25-45 degrees relative to the floor surface.

Figure 7:
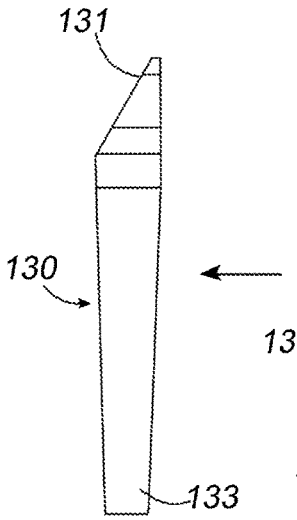
FIG. 7 is a first side elevation of an insertable scraper component.
Figure 8:
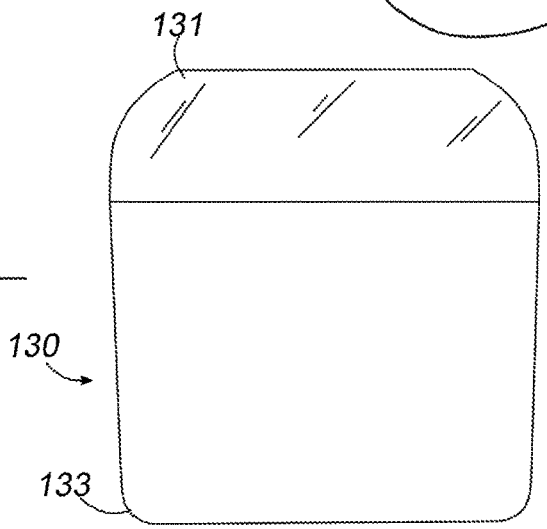
FIG. 8 is a second side elevation of an insertable scraper component.
Figure 9:
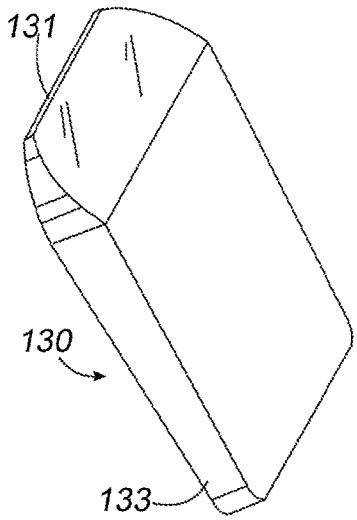
FIG. 9 is a perspective view thereof.
Figure 10:
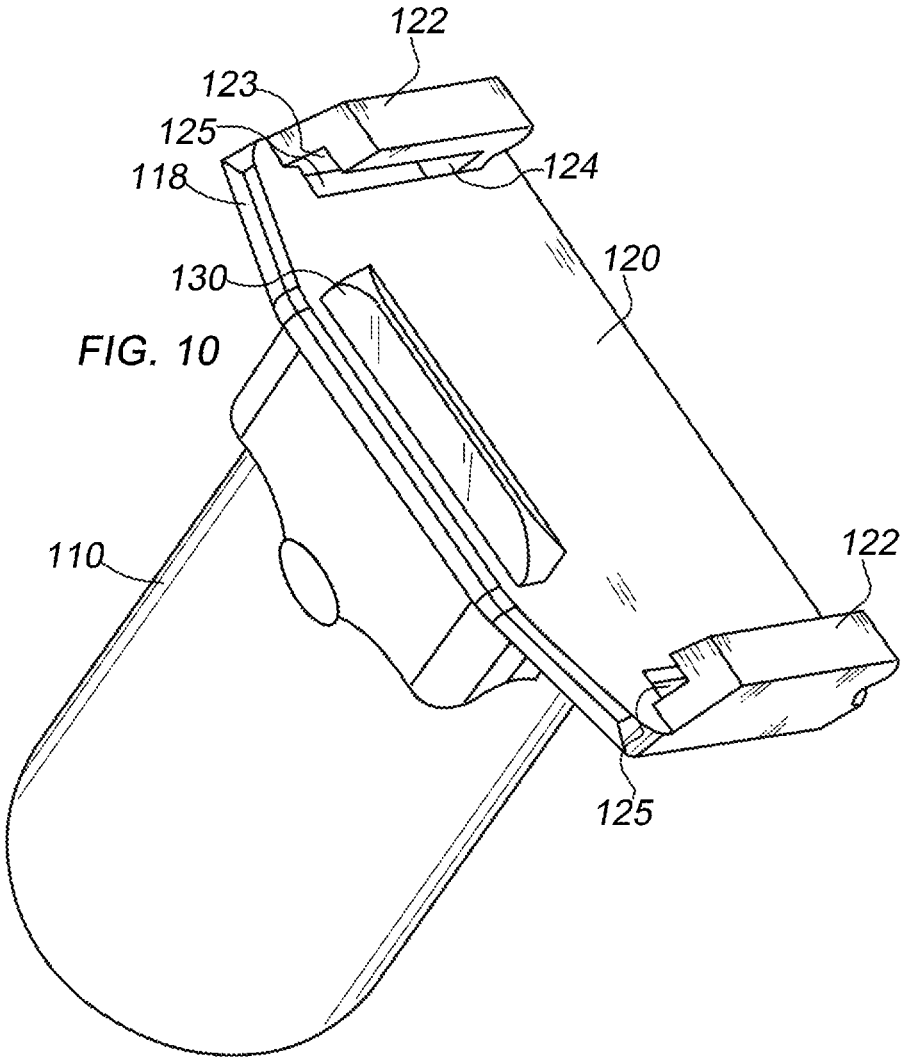
FIG. 10 is perspective view of a second implementation including an inserted scraper component.

FIGS. 7-9 show different views of an exemplary scraper member employable with various implementations disclosed herein. The scraper member includes a blade end 131 and a support end 132 that is insertable into the body of the detail head. The blade end may be detachable and in various implementations may be re-sharpened when necessary. Various blade ends of various configurations may be interchangeable and disposable after use.

Figure 11:
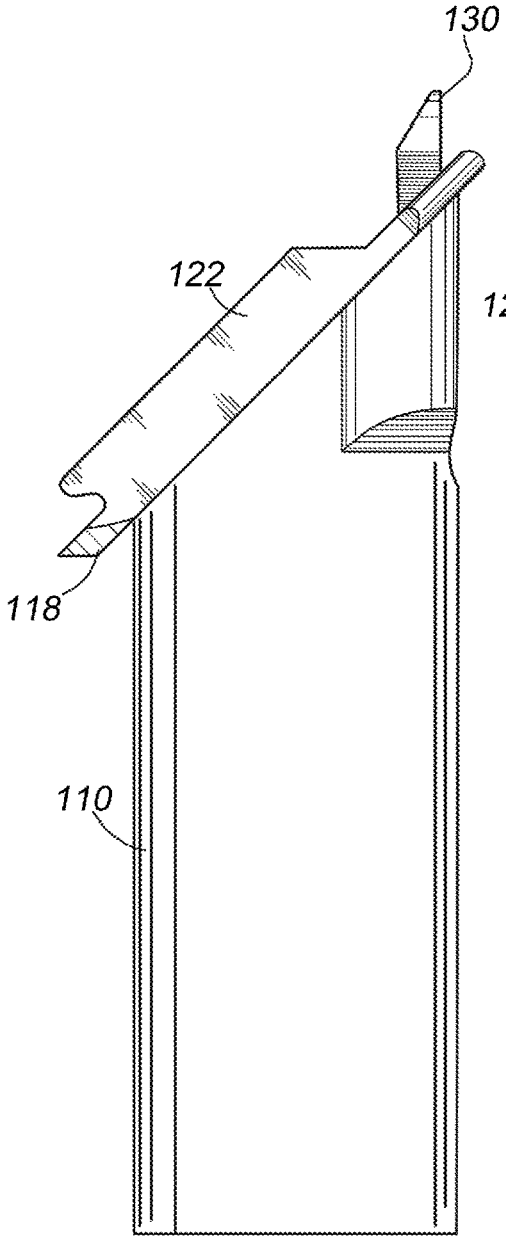
FIG. 11 is a side elevation of the implementation of (FIG. 10)
Figure 12:
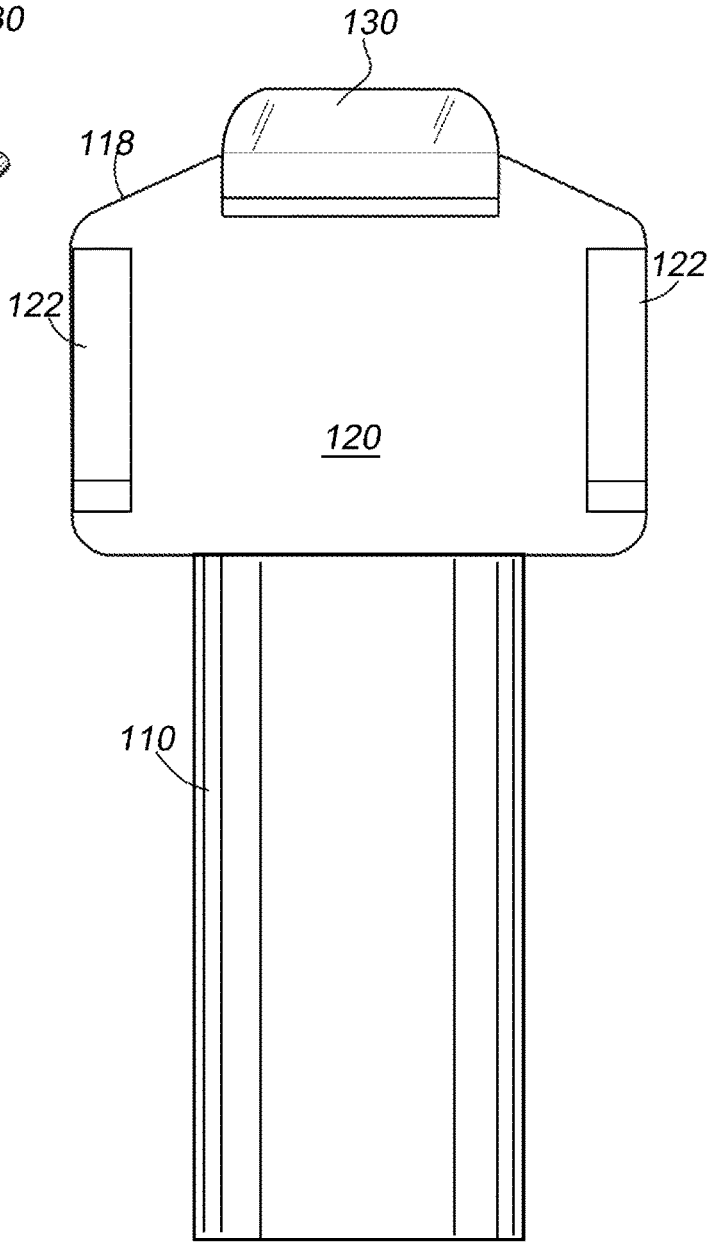
FIG. 12 is a side elevation of the implementation of (FIG. 11) taken in the direction of arrow (c)
Figure 13:
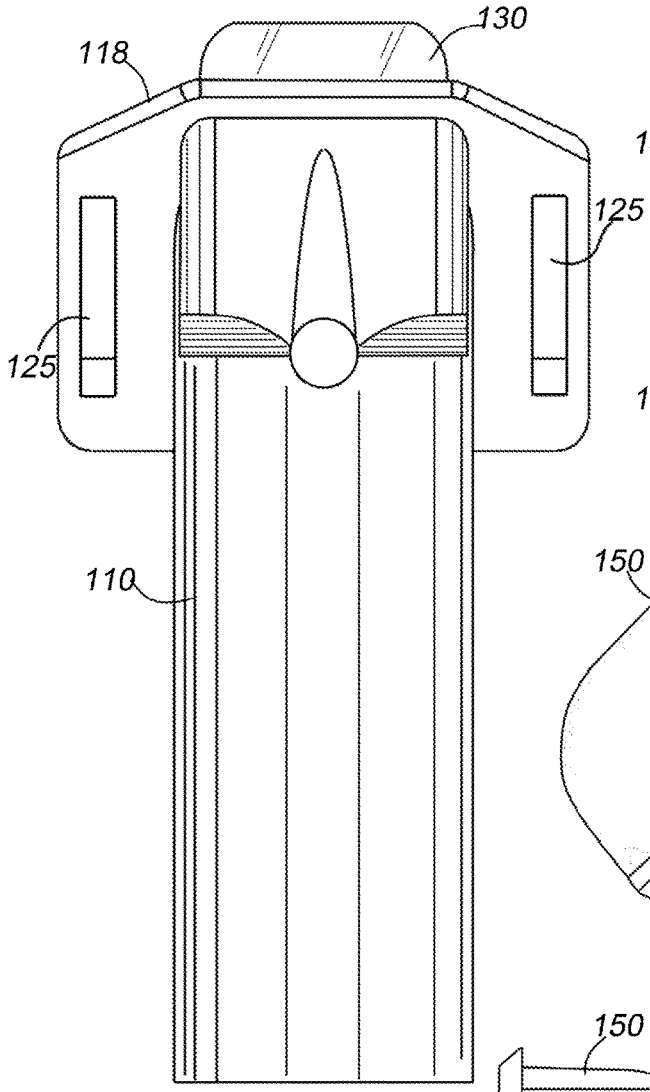
FIG. 13 is a side elevation taken in the direction opposite that of (FIG. 12)
Figure 14:
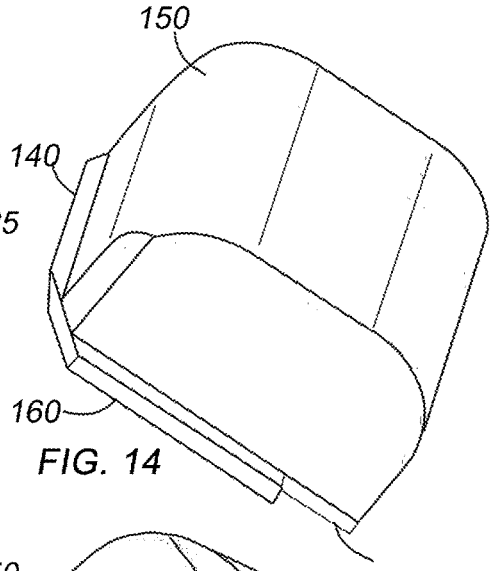
FIG. 14 is a first perspective view of a pad member.
Figure 15:
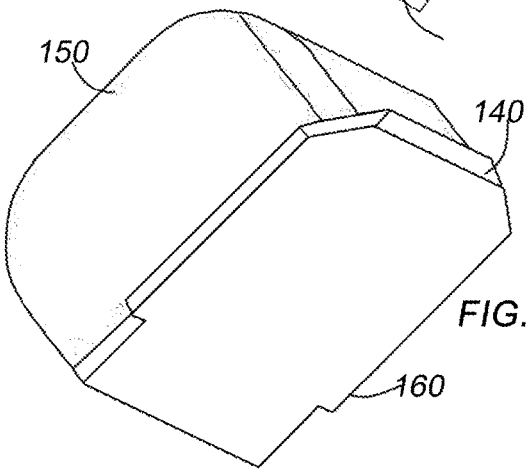
FIG. 15 is a second perspective view of a pad member.
Figure 16:
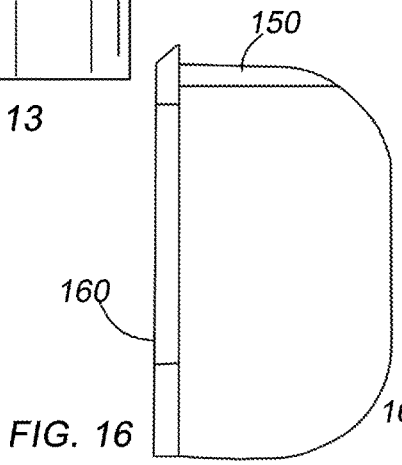
FIG. 16 is a first side elevation of the pad member shown in (FIGS. 14, 15)
Figure 17:
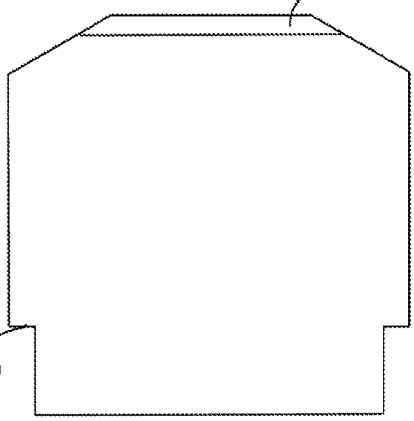
FIG. 17 is a second side elevation thereof.

FIGS. 11-13 show the detail head 100 with installed scraper member 130, prior to installation of the pad member 140.

Figure 18:
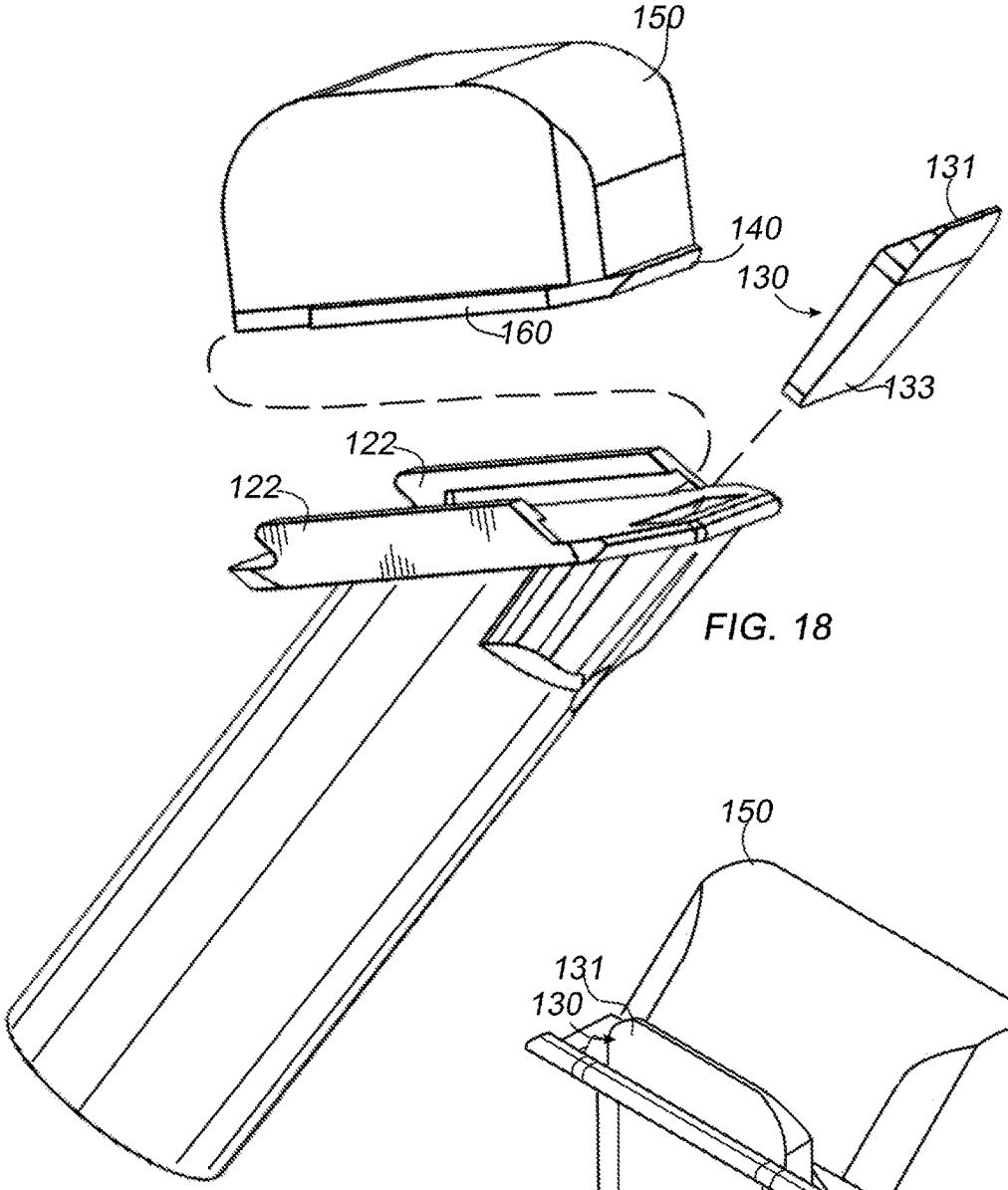
FIG. 18 is an exploded view of an implementation according to the present invention including a pad component, and the scraper component.
Figure 19:
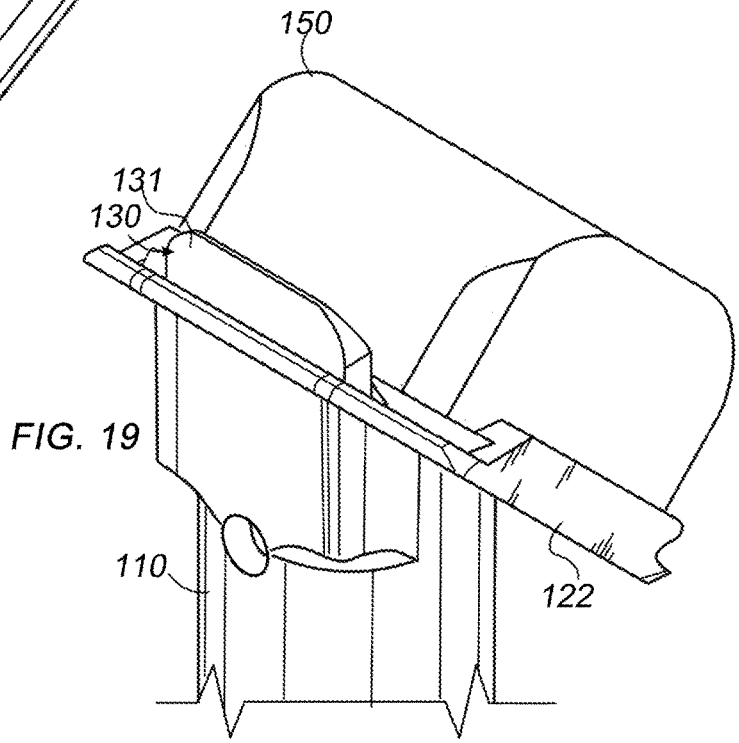
FIG. 19 is a partial perspective view thereof.

FIGS. 14-17 are various views of a pad member 150 that includes a pad adhered to, or otherwise mated to a plate portion 140 that includes flanges 160. Note that the plate portion includes a angled portion configured to seat next to the back of the scraper member 130 if one is installed. The pad portion may be absorbent or non-absorbent, abrasive or non-abrasive. Abrasiveness may vary from one portion of the pad to another, e.g., front to back. It is conceivable that the plate portion may be symmetrically shaped and thereby reversible, e.g., front to back, back to front. FIG. 18 is an exploded view showing an arrangement of the various components of a detail cleaning head assembly.

FIGS. 19-22 are various enlarged partial views that show the nesting of the pad member 150 directly adjacent to and behind the scraper member 130. Turning to FIG. 20, fs1, fs2 and fs3 represent floor surfaces. It should be noted that the more acute the angle of attack for the blade 131, (e.g., fs3), the greater the area of the pad 150 in contact with the floor surface. When the handle is at 45 degrees relative to the floor, (e.g., fs4), the full face of the pad is in contact with the floor.

While preferably the body of the cleaning implement which includes the handle attachment portion and the angled face is made of a durable elastomer such as Santoprene®, it can be formed of any suitable material which would suggest itself to person having skill in the art and access to this disclosure.

The scraper member can be made of Acrylonitrile butadiene styrene (ABS), glass fiber filled nylon, or any suitable thermoplastic, and can be wholly plastic, tipped with a metal, or otherwise paired with a metal blade. A seated scraper is removed or interchanged with another by firmly grasping and pulling with the fingers.

It should be understood that the drawings and detailed description herein are to be regarded in an illustrative rather than a restrictive manner, and are not intended to be limiting to the particular forms and examples disclosed. Accordingly, it is intended that this disclosure encompass any further modifications, changes, rearrangements, substitutions, alternatives, design choices, and embodiments as would be appreciated by those of ordinary skill in the art having benefit of this disclosure, and falling within the spirit and scope of the following claims.

The invention claimed is:

1. A detail cleaning head assembly for removing hardened and semi-hardened residue on surfaces to be cleaned comprising:

a handle including a handle axis and a platform portion, the platform portion includes a front side, a back side, a pair of retention members, and a tapered recess configured to taper in a direction toward the handle;

a pad member including a pad portion and a plate portion adapted to slidably couple with the retention members on the front side of the platform portion;

a scraper blade adapted to attach to the front side of the platform portion, the scraper blade includes at least a forward portion adapted to scrape a floor surface and a support portion tapering to a hindmost portion configured for a friction fit within the tapered recess;

the detail cleaning head configured such that removal of a pad member when coupled to the platform is prevented when the scraper blade is attached to the platform; and, the forward portion of the scraper blade is capable of contact with the floor surface simultaneously with the pad portion when the front side of the platform is disposed in a floor facing direction and the handle is supported at a 45 degree angle with respect to the floor surface.

2. The assembly according to claim 1, the scraper blade comprising a tapering forward portion.

3. The assembly according to claim 1 further comprising a hollow section inside of the handle.

4. The assembly according to claim 1 wherein the scraper blade and pad member are configured to be mounted together on the platform.

5. The assembly according to claim 1 further comprising a face portion of the platform portion, and the face portion is substantially at 45 degrees relative to the handle axis.

6. The pad member according to claim 1 comprising an absorbent material capable of laying down wax or floor sealer.

7. The assembly according to claim 1 wherein the pad portion is abrasive or non-abrasive.

* * * * *